US007678206B2

(12) United States Patent
Sakaki

(10) Patent No.: US 7,678,206 B2
(45) Date of Patent: Mar. 16, 2010

(54) MANUFACTURING METHOD OF ROCKER ARM BEARING APPARATUS

(75) Inventor: Yoshiaki Sakaki, Hamura (JP)

(73) Assignee: JTEKT Corporation, Osaka-shi (JP)

( * ) Notice: Subject to any disclaimer, the term of this patent is extended or adjusted under 35 U.S.C. 154(b) by 0 days.

(21) Appl. No.: 12/071,491

(22) Filed: Feb. 21, 2008

(65) Prior Publication Data

US 2008/0202640 A1 Aug. 28, 2008

(30) Foreign Application Priority Data

Feb. 23, 2007 (JP) ..... 2007-044342

(51) Int. Cl.
*B32B 15/01* (2006.01)

(52) U.S. Cl. ..... 148/527; 148/516

(58) Field of Classification Search ..... 148/516, 148/527

See application file for complete search history.

(56) References Cited

U.S. PATENT DOCUMENTS

2006/0120651 A1* 6/2006 Ochi ..... 384/548
2007/0125416 A1* 6/2007 Iwanade et al. ..... 136/236.1

FOREIGN PATENT DOCUMENTS

| | | | |
|---|---|---|---|
| JP | 2000-27978 | | 1/2000 |
| JP | 2003-240103 | | 8/2003 |
| JP | 2003-328706 | | 11/2003 |
| JP | 2004-156688 | | 6/2004 |
| JP | 2006-144848 | * | 6/2006 |

* cited by examiner

*Primary Examiner*—Timothy C Vanoy
*Assistant Examiner*—Daniel Berns
(74) *Attorney, Agent, or Firm*—McGinn IP Law Group PLLC

(57) ABSTRACT

Quenching heat treatment is performed on a whole rocker arm bearing assembly in which shaft ends of a supporting shaft are fixed to inner peripheral edges of shaft end insertion holes of a pair of opposite sidewalls, and by the outer ring is rotatably supported on a raceway portion of an shaft intermediate portion of the supporting shaft through a plurality of rolling elements or directly, thereby manufacturing a rocker arm bearing apparatus.

20 Claims, 3 Drawing Sheets

MANUFACTURING METHOD OF ROCKER ARM BEARING APPARATUS

BACKGROUND OF THE INVENTION

The present invention relates to a manufacturing method of a rocker arm bearing apparatus assembled into a rocker arm that operates to open or close valves attached to a valve train of an engine or like of an automobile.

A rocker arm is attached to a valve train of an automobile engine, and its body rocks about a lash adjuster receiver (pivot receiver) or a rocker arm shaft with the rotation of a valve system cam, thereby operating to open or close the valves of the automobile engine.

A conventional rocker arm bearing apparatus assembled into such a rocker arm includes a pair of opposite sidewalls that constitute a rocker arm body as a bearing holding member, a supporting shaft in which end faces of its shaft ends are caulked on inner peripheral edges of shaft end insertion holes of the pair of opposite sidewalls, and an outer ring rotatably supported on a raceway portion of a shaft intermediate portion of the supporting shaft directly or through a plurality of rolling elements. An external surface of the raceway portion of the shaft intermediate portion of the supporting shaft is hardened by high-frequency quenching. Also, end faces of both the shaft ends are made to have surface hardness capable of being caulked without heat treatment, and thus, the shaft ends are fixedly caulked on inner peripheral edges of shaft end insertion holes of the opposite sidewalls (for example, refer to JP-A-2004-156688).

In the conventional rocker arm bearing apparatus, the supporting shaft is inserted into the shaft end insertion holes of the pair of opposite sidewalls, and after the insertion of the supporting shaft, the end faces of the shaft ends of the supporting shaft are fixedly caulked on the inner peripheral edges of the shaft end insertion holes. In terms of the functions of a bearing, it is necessary that quenching heat treatment is performed in advance in the vicinity of a shaft center portion that is a roller rolling portion of the supporting shaft. However, both the shaft ends of the supporting shaft should not be subjected to heat treatment in order to perform caulking. Such heat treatment of the supporting shaft is limited to local high-frequency quenching using a high-frequency induction heating coil since normal quenching cannot be performed. Thus, there is a problem in that time and efforts are required.

SUMMARY OF THE INVENTION

The invention has been made in order to solve such a problem. It is therefore the object of the invention to obtain a manufacturing method of a rocker arm bearing apparatus capable of simplifying a quenching process.

In order to achieve the object, the present invention has the following processes.

(1) A method of manufacturing a rocker arm bearing apparatus that comprises: a pair of opposite sidewalls including shaft end insertion holes, respectively; a supporting shaft that includes a raceway portion on a intermediate portion thereof and opposite shaft ends fixed to inner peripheral edges of the shaft end insertion holes, respectively; and an outer ring rotatably supported on the raceway portion through a plurality of rolling elements or directly, the method comprising:

inserting the opposite shaft ends into the shaft end insertion holes, respectively;

fixing the shaft ends to the inner peripheral edges of the shaft end insertion holes to form a rocker arm bearing assembly in which the shaft ends are fixed to the inner peripheral edges of the shaft end insertion holes and the outer ring is rotatably supported on the raceway portion through the plurality of rolling elements or directly; and performing quenching heat treatment on the whole of the rocker arm bearing assembly.

(2) The method according to (1), wherein the shaft ends are fixed to the inner peripheral edges of the shaft end insertion holes by caulking or welding.

(3) The method according to (1), wherein the quenching heat treatment is performed under vacuum or an atmosphere of inert gas.

According to the invention, quenching heat treatment is performed on the whole rocker arm bearing assembly in which the shaft ends are fixed to the inner peripheral edges of the shaft end insertion holes and the outer ring is rotatably supported on the raceway portion through the plurality of rolling elements or directly, thereby manufacturing the rocker arm bearing apparatus. Thus, it is possible to dispense with complicated and time-consuming high-frequency quenching unlike the prior art, it is possible to simplify the quenching process, and it is possible to efficiently assemble the rocker arm bearing apparatus. Further, since the fixing means is caulking or welding, it is possible to achieve simple fixation. Moreover, the quenching heat treatment of the rocker arm bearing assembly is quenching heat treatment performed under vacuum or an atmoshere of inert gas. This lessens the adhesion of scales.

DETAILED DESCRIPTION OF PREFERRED EMBODIMENTS

Embodiment 1

Figure 1:
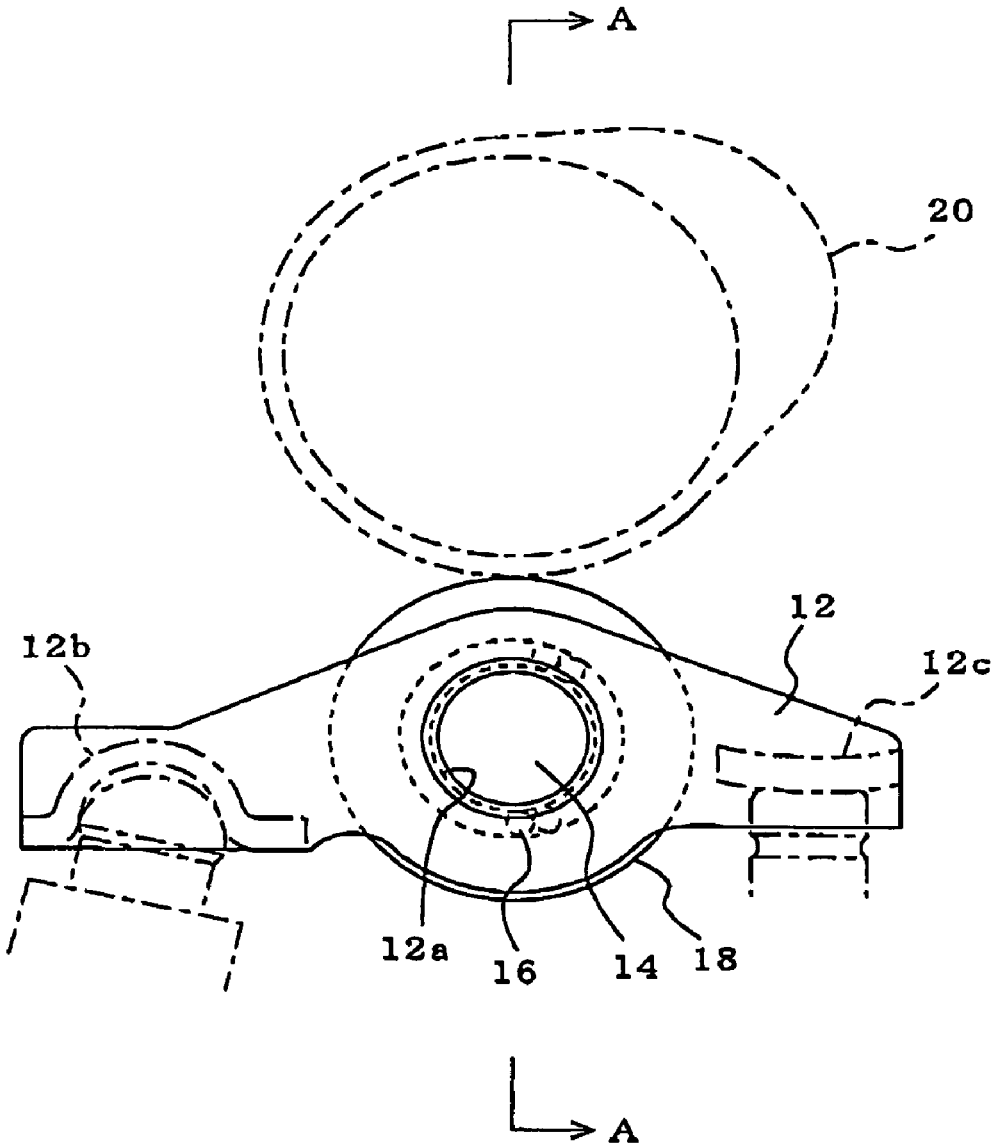
FIG. 1 is a side view of a rocker arm into which a rocker arm bearing apparatus according to an embodiment of the invention is assembled.
Figure 2:
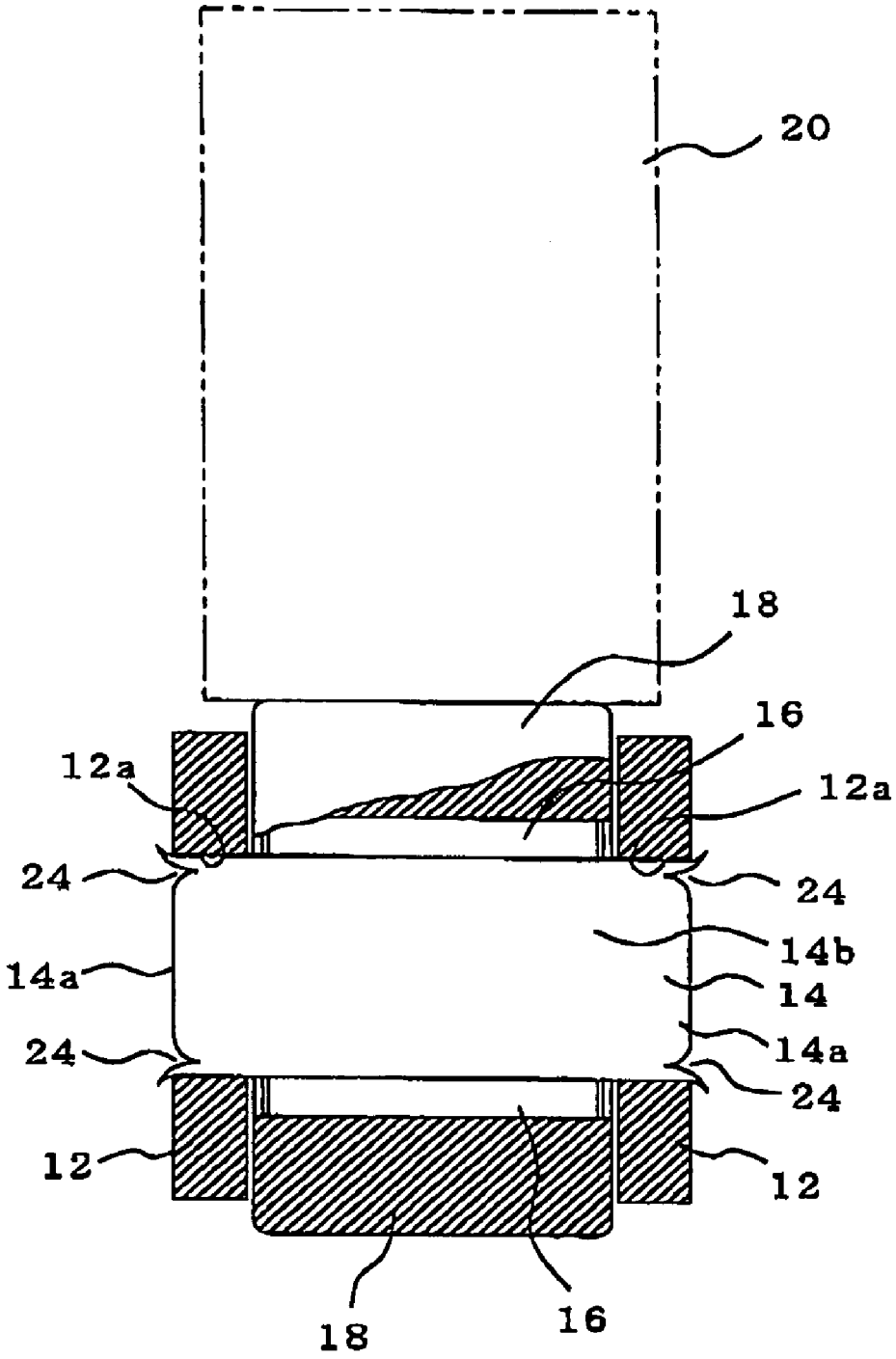
FIG. 2 is a sectional view taken along the line A-A of FIG. 1.

FIG. 1 is a side view of an end-pivot-type rocker arm provided with a rocker arm bearing apparatus according to Embodiment 1 of the invention. FIG. 2 is a sectional view taken along the line A-A of FIG. 1.

In the drawings, the rocker arm bearing apparatus according to the embodiment of the invention assembled into the rocker arm includes a pair of opposite sidewalls 12 that constitute a rocker arm body as a bearing holding member, a supporting shaft 14 inserted into and fixed to shaft end insertion holes 12*a* of the pair of opposite sidewalls 12, and an outer ring 18 rotatably supported on a raceway portion of a shaft intermediate portion of the supporting shaft 14 through a plurality of needle rollers 16. A cam 20 abuts against an outer peripheral surface of the outer ring 18, thereby constituting the rocker arm.

The pair of opposite sidewalls 12 are made of, for example, steel, and face each other in parallel in the same shape. A lash adjuster receiver 12*b* and a valve stem receiver 12*c* are respectively provided on both sides of the opposite sidewalls 12 in their longitudinal direction, and the pair of opposite sidewalls 12 are configured integrally through the lash adjuster receiver 12*b* and the valve stem receiver 12*c*.

The shaft end insertion holes 12*a* formed in the pair of opposite sidewalls 12, respectively, axially pass through the opposite sidewalls 12 with the same fixed hole diameter.

Further, the supporting shaft 14 is made of steel, and although the type of the steel is not particularly limited, steel, such as SUS, STJ, or SKH, is preferable.

Shaft ends 14*a* of the supporting shaft 14 are inserted into the shaft end insertion holes 12*a* of the pair of opposite sidewalls 12, and the outer ring 18 is rotatably and externally fitted on and supported by the shaft intermediate portion 14*b* between the pair of opposite sidewalls 12 through the plurality of needle rollers 16 as rolling elements that are made of, for example, steel. The cam 20 abuts against the outer peripheral surface of the outer ring 18.

Next, a method of manufacturing the rocker arm bearing apparatus according to an embodiment 1 of the invention will be described.

First, an assembly in which the outer ring 18 is rotatably assembled on a rubber shaft having such length that the rubber shaft enters a gap between the pair of opposite sidewalls 12, the same diameter as the supporting shaft 14, and a width that is below the width of the outer ring 18, through the plurality of needle rollers 16, is formed.

Next, the assembly is interposed between the pair of opposite sidewalls 12, and both ends of the rubber shaft is matched with the shaft end insertion holes 12*a* of the pair of opposite sidewalls 12.

Thereafter, the supporting shaft 14 is inserted from the shaft end insertion hole 12*a* of one opposite sidewall 12, and the rubber shaft is made to gradually jump out of the shaft end insertion hole 12*a* of the other opposite sidewall 12. When the tip of the supporting shaft 14 arrived at the shaft end insertion holes 12*a* of the other opposite sidewall 12, the supporting shaft 14 can finally be inserted into the shaft end insertion holes 12*a* of the pair of opposite sidewalls 12 instead of the rubber shaft, and the outer ring 18 can be rotatably assembled to the supporting shaft 14 through the plurality of needle rollers 16.

After such insertion of the supporting shaft 14 into the shaft end insertion holes 12*a*, as shown in FIG. 2, a rocker arm bearing assembly is assembled by fixedly caulking end faces of the shaft ends of the supporting shaft 14 to inner peripheral edges of the shaft end insertion holes 12*a*. The caulked portion is denoted by reference numeral 24.

The whole rocker arm bearing assembly that is assembled in this way is typically subjected to quenching heat treatment, such as quenching and the following tempering, under vacuum or an atmosphere of inert gas, such as argon gas, whereby the rocker arm bearing apparatus as a product is completed.

In addition, in a case where scales have adhered to the rocker arm bearing apparatus, they can be removed by performing chemical treatment, such as acid cleaning, after heat treatment.

According to the embodiment 1, after insertion of the supporting shaft 14 including the plurality of needle rollers 16 and the outer ring 18 into the shaft end insertion holes 12*a* of the pair of opposite sidewalls 12, as shown in FIG. 2, a rocker arm bearing assembly is assembled by fixedly caulking the end faces of the shaft ends 14*a* of the supporting shaft 14 to the inner peripheral edges of the shaft end insertion holes 12*a*. Then, the whole rocker arm bearing assembly that is assembled in this way is typically subjected to heat treatment including normal quenching and tempering, under an atmosphere of inert gas, such as argon gas, whereby the rocker arm bearing apparatus is completed. Thus, it is possible to dispense with complicated and time-consuming high-frequency quenching unlike the prior art, it is possible to simplify a quenching process, and it is possible to efficiently assemble the rocker arm bearing apparatus.

Embodiment 2

Figure 3:
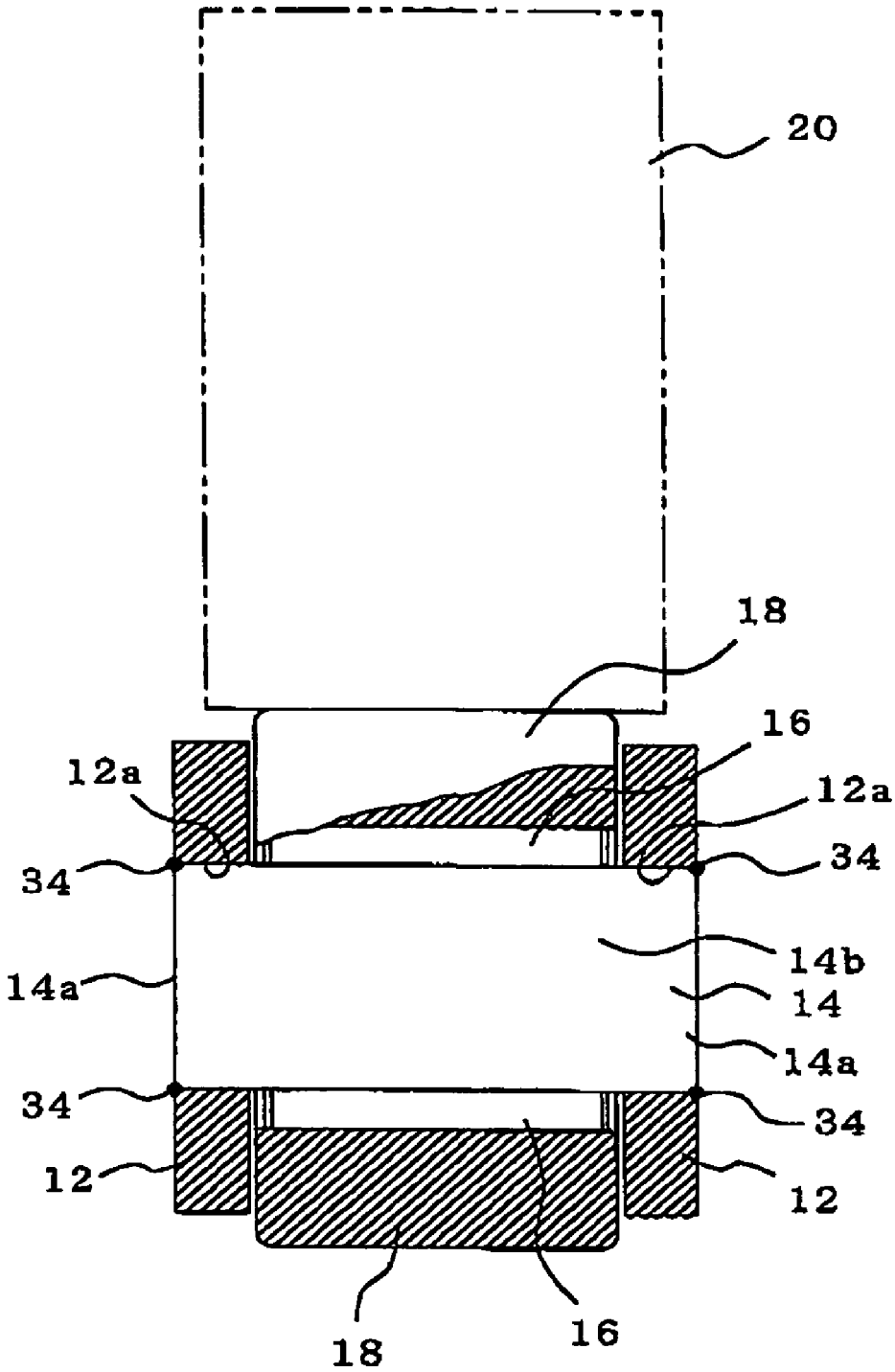
FIG. 3 is a sectional view of a rocker arm bearing apparatus according to an embodiment 2 of the invention.

FIG. 3 is a sectional view of a rocker arm bearing apparatus according to an embodiment 2 of the invention.

In the embodiment 2, the same components as those of the above Embodiment 1 are denoted by the same reference numerals, and the description of the duplicate components is omitted.

This Embodiment 2 is different from Embodiment 1 in attaching the supporting shaft 14 to the pair of opposite sidewalls 12.

That is, in the above Embodiment 1, the rocker arm bearing assembly is assembled by fixedly caulking the end faces of the shaft ends 14*a* of the supporting shaft 14 on the inner peripheral edges of the shaft end insertion holes 12*a*. However, in this Embodiment 2, after insertion of the supporting shaft 14 into the shaft end insertion holes 12*a* of the pair of opposite sidewalls 12, as shown in FIG. 3, the rocker arm bearing assembly is assembled by fixedly welding (34) the inner peripheral edges of the shaft end insertion holes 12*a*, and the end face outer edges of the shaft ends 14*a* of the supporting shaft 14 to each other. Then, the whole rocker arm bearing assembly that is assembled in this way is typically subjected to heat treatment including normal quenching and tempering, under vacuum or an atmosphere of inert gas, such as argon gas, whereby the rocker arm bearing apparatus as a product is completed.

In addition, in a case where scales have adhered to the rocker arm bearing apparatus, they can be removed by performing chemical treatment, such as acid cleaning, or mechanical treatment, such as shot blasting, after heat treatment.

Like this Embodiment 2, after insertion of the supporting shaft 14 including the plurality of needle rollers 16 and the outer ring 18 into the shaft end insertion holes 12*a* of the pair of opposite sidewalls 12, as shown in FIG. 3, the rocker arm bearing assembly is assembled by fixedly welding (34) the whole periphery between the inner peripheral edges of the shaft end insertion holes 12*a* and the end face outer edges of the shaft ends 14*a* of the supporting shaft 14. Then, the whole rocker arm bearing assembly that is assembled in this way is typically subjected to heat treatment including normal quenching and tempering, under an atmosphere of inert gas, such as argon gas, whereby the rocker arm bearing apparatus is completed. Thus, it is possible to dispense with complicated and time-consuming high-frequency quenching unlike the prior art, it is possible to simplify a quenching process, and it is possible to efficiently assemble the rocker arm bearing apparatus.

Further, in the above embodiment, the pair of opposite sidewalls 12 and the supporting shaft 14 are fixed by welding (34). Thus, it is not necessary to take into consideration occurrence of deformation in the supporting shaft 14 by caulking, and it is possible to efficiently assemble the rocker arm bearing apparatus.

In addition, in this embodiment 2, the whole periphery between the inner peripheral edges of the shaft end insertion holes 12*a* and the end face outer edges of the shaft ends 14*a* of the supporting shaft 14 is fixedly welded (34). However, the whole periphery may not be welded (34) if sufficient joining strength is guaranteed.

Although normal quenching is shown as quenching heat treatment on the rocker arm bearing assembly in the above Embodiments 1 and 2, it is needless to say that other quenching heat treatment, such as carburizing or carbonitriding, can be applied. Further, although, in the embodiments, the outer ring is rotatably held by the shaft through the rolling elements, the outer ring may be directly rotatably held by the shaft to slide contact therewith without using the rolling elements.

Further, the rocker arm bearing apparatus of the above Embodiments 1 and 2 can also be applied to a center-pivot-type rocker arm.

What is claimed is:

1. A method of manufacturing a rocker arm bearing apparatus that includes a pair of opposite sidewalls including shaft end insertion holes, respectively; a supporting shaft that includes a raceway portion on an intermediate portion thereof and opposite shaft ends fixed to inner peripheral edges of the shaft end insertion holes, respectively; and an outer ring rotatably supported on the raceway portion through a plurality of rolling elements or directly, the method comprising:

inserting the opposite shaft ends into the shaft end insertion holes, respectively;

fixing the shaft ends to the inner peripheral edges of the shaft end insertion holes to form a rocker arm bearing assembly in which the shaft ends are fixed to the inner peripheral edges of the shaft end insertion holes and the outer ring is rotatably supported on the raceway portion through the plurality of rolling elements or directly; and performing quenching heat treatment on an entirety of the rocker arm bearing assembly.

2. The method according to claim 1, wherein the shaft ends are fixed to the inner peripheral edges of the shaft end insertion holes by caulking or welding.

3. The method according to claim 1, wherein the quenching heat treatment is performed under vacuum or an atmosphere of inert gas.

4. A method of manufacturing a rocker arm bearing apparatus comprising:

forming a pair of opposite sidewalls including shaft end insertion holes;

providing a supporting shaft that includes a raceway portion on an intermediate portion of the supporting shaft and opposite shaft ends fixed to inner peripheral edges of the shaft end insertion holes;

forming an outer ring rotatably supported on the raceway portion;

inserting the opposite shaft ends into the shaft end insertion holes;

fixing the shaft ends to the inner peripheral edges of the shaft end insertion holes to form a rocker arm bearing assembly in which the shaft ends are fixed to the inner peripheral edges of the shaft end insertion holes and the outer ring is rotatably supported on the raceway portion; and performing quenching heat treatment on an entirety of the rocker arm bearing assembly.

5. The method according to claim 1, wherein the pair of opposite side walls comprise a steel.

6. The method according to claim 1, wherein the rocker arm bearing assembly further comprises a lash adjuster receiver and a valve stem receiver which are respectively provided on the opposite sidewalls in their longitudinal direction.

7. The method according to claim 1, wherein the supporting shaft comprises a steel.

8. The method according to claim 1, wherein the inserting the opposite shaft ends into the shaft end insertion holes further comprises:

rotatably assembling the outer ring on a rubber shaft comprising a width less than a width of the outer ring, such that the rubber shaft enters a gap between the pair of opposite side walls, through the plurality of rolling elements;

interposing the rubber shaft between the pair of opposite sidewalls, such that both ends of the rubber shaft are aligned with the shaft end insertion holes; and inserting the support shaft into a shaft end insertion hole towards another of the shaft end insertion holes such that the rubber shaft is pushed out of the other shaft insertion hole.

9. The method according to claim 1, wherein the shaft ends are fixed to the inner peripheral edges of the shaft end insertion holes by welding.

10. The method according to claim 1, wherein the quenching heat treatment includes quenching and tempering.

11. The method according to claim 1, wherein the quenching heat treatment is performed under an atmosphere of inert gas.

12. The method according to claim 1, further comprising:

after performing the quenching heat treatment, performing a chemical treatment which removes scales adhered to the rocker arm bearing apparatus.

13. The method according to claim 1, further comprising:

after performing quenching heat treatment, performing a mechanical treatment which removes scales adhered to the rocker arm bearing apparatus.

14. The method according to claim 1, wherein the quenching heat treatment comprises carburizing or carbonitriding.

15. The method according to claim 13, wherein the mechanical treatment comprises shot blasting.

16. The method according to claim 12, wherein the chemical treatment comprises acid cleaning.

17. A rocker arm bearing apparatus comprising:

a pair of opposite sidewalls including shaft end insertion holes;

a supporting shaft that includes a raceway portion on a intermediate portion of the supporting shaft and opposite shaft ends fixed to inner peripheral edges of the shaft end insertion holes to form a rocker arm bearing assembly; and an outer ring rotatably supported on the raceway portion, wherein an entirety of the rocker arm bearing assembly comprises a quench heat treated structure.

18. The rocker arm according to claim 17, wherein the shaft ends are fixed to the inner peripheral edges of the shaft end insertion holes by at least one of caulking and welding.

19. The rocker arm according to claim 17, wherein the outer ring is rotatably supported on the raceway portion through a plurality of rolling elements.

20. The method according to claim 1, wherein the quenching heat treatment is performed under vacuum.

* * * * *